US008678881B2

(12) United States Patent
Junker

(10) Patent No.: US 8,678,881 B2
(45) **Date of Patent: *Mar. 25, 2014**

(54) GRINDING CENTER AND METHOD FOR SIMULTANEOUS GRINDING OF A PLURALITY OF BEARINGS AND END-SIDE SURFACES OF CRANKSHAFTS

(75) Inventor: Erwin Junker, Buehl/Baden (DE)

(73) Assignee: Erwin Junker Maschinenfabrik GmbH, Nordrach (DE)

( * ) Notice: Subject to any disclaimer, the term of this patent is extended or adjusted under 35 U.S.C. 154(b) by 822 days.

This patent is subject to a terminal disclaimer.

(21) Appl. No.: 12/670,623

(22) PCT Filed: Jul. 22, 2008

(86) PCT No.: PCT/EP2008/059612

§ 371 (c)(1),
(2), (4) Date: Feb. 25, 2010

(87) PCT Pub. No.: WO2009/013295

PCT Pub. Date: Jan. 29, 2009

(65) Prior Publication Data

US 2010/0203805 A1 Aug. 12, 2010

(30) Foreign Application Priority Data

Jul. 25, 2007 (DE) ..... 10 2007 034 706

(51) Int. Cl.
*B24B 49/00* (2012.01)

(52) U.S. Cl.
USPC ..... 451/11; 451/249

(58) Field of Classification Search
USPC ..... 451/5, 8, 10, 11, 411, 397, 398, 402, 451/242, 246, 249
See application file for complete search history.

(56) References Cited

U.S. PATENT DOCUMENTS

| | | | | |
|---|---|---|---|---|
| 3,487,588 | A * | 1/1970 | Temple | 451/11 |
| 4,116,111 | A * | 9/1978 | Schmid | 409/166 |
| 4,423,990 | A * | 1/1984 | Kodama et al. | 409/132 |
| 4,951,419 | A * | 8/1990 | Weber | 451/65 |
| 5,997,452 | A | 12/1999 | Assie | |
| 6,409,573 | B1 | 6/2002 | Mukai et al. | |
| 6,878,043 | B1 | 4/2005 | Junker | |
| 7,628,676 | B2 * | 12/2009 | Tanner | 451/8 |
| 2003/0139120 | A1 * | 7/2003 | Ito et al. | 451/49 |
| 2004/0248502 | A1 | 12/2004 | Junker | |

FOREIGN PATENT DOCUMENTS

| | | |
|---|---|---|
| CN | 1541150 | 10/2004 |
| DE | 1 577 442 | 10/1971 |
| DE | 10144644 | 4/2003 |
| EP | 1044764 | 10/2000 |

(Continued)

*Primary Examiner* — Maurina Rachuba
(74) *Attorney, Agent, or Firm* — Jordan and Hamburg LLP

(57) ABSTRACT

A grinding center for the simultaneous grinding of a plurality of main and rod bearings and/or central and end-side sections of crankshafts includes first and second stations. Two main bearing grinding spindles, of which the first is movable only in the Z-direction and the second only insignificantly movable in the X-direction, are mounted on a common rod bearing-compound slide. In the final phase of grinding, a correction of variations in size between the two processed rod bearings occurs via a separated drive of the second rod bearing-grinding spindle in accordance with a size or roundness correction. The variations are detected by measuring devices. An inclined profiled grinding wheel is provided for the grinding of the end sections.

19 Claims, 10 Drawing Sheets

(56) References Cited

FOREIGN PATENT DOCUMENTS

| | | |
|---|---|---|
| EP | 1088621 | 4/2001 |
| EP | 1718435 | 11/2006 |
| JP | 9-501615 | 2/1997 |
| JP | 11-500364 | 1/1999 |
| JP | 2001-096459 | 4/2001 |
| JP | 2003-136379 | 5/2003 |
| JP | 2006-263835 | 10/2006 |
| RU | 2 240 218 | 11/2004 |
| WO | WO-2004/069472 | 8/2004 |
| WO | WO-2005/000507 | 1/2005 |

* cited by examiner

GRINDING CENTER AND METHOD FOR SIMULTANEOUS GRINDING OF A PLURALITY OF BEARINGS AND END-SIDE SURFACES OF CRANKSHAFTS

BACKGROUND OF THE INVENTION

The invention relates to a grinding center for grinding crankshafts having main bearings and pin bearings, a plurality of main bearings and pin bearings as well as end-side surfaces, especially of a flange, being ground essentially simultaneously.

Such grinding centers are used for rough-grinding and/or finish-grinding of large numbers of crankshafts. These are often crankshafts for four cylinder in-line engines in the automobile industry, in which engines each of two pin bearings are arranged at the same angular position with respect to the longitudinal axis of the crankshaft. These two pin bearings are ground simultaneously (time parallel) in order to increase productivity. One such procedure is described for instance in EP 1 044 764 A2 and EP 1 088 621 B1.

Simultaneously grinding a plurality of bearings has been known for some time for the main bearings of crankshafts, e.g., from U.S. Pat. No. 3,487,588. The grinding spindle for the main bearings has a number of grinding wheels that is equal to the number of main bearings. The grinding wheels are disposed on a common axis. A more recent version of this can be found in DE 101 44 644 B4.

In the grinding center for crankshafts in accordance with EP 1 044 674 A2, used for simultaneous grinding of two pin bearings on a crankshaft are a rough-grinding wheel and a finish-grinding wheel that are each securely mounted to discrete compound slide rests via the associated grinding spindle. The two compound slide rests can be moved independently of one another in the crankshaft longitudinal direction (Z direction) and can be adjusted relative to the crankshaft (X direction). Appropriately controlling the compound slide rests and the grinding spindles makes it possible to machine two pin bearings simultaneously in one clamping process, the one pin bearing being pre-ground and the other being finish-ground. The grinding process is monitored continuously via associated measuring devices.

EP 1 088 621 B1 describes a method and an apparatus for simultaneously grinding at least two bearings on a crankshaft that is essentially the same as the grinding center depicted in EP 1 044 764 A2 in terms of design and operation. Each of these systems uses a discrete compound slide rest for each of the two grinding spindles used. Each of these compound slide rests requires separate activation for the entire grinding process and continuous monitoring and correction according to real-time data, acquired via measuring heads, about the roundness and dimensions of the ground bearing. Simply in terms of the machining two bearings, the design of the grinding center with two separate compound slide rests requires a great deal of space and significant complexity with regard to components and associated controls.

EP 1 718 435 B1 describes a machine for machining workpieces in which machine grinding and/or turning apparatus are present. The grinding apparatus has a profiled grinding wheel that is inclined relative to the Z axis and by means of which the workpiece can be both face ground and also externally cylindrically ground. The tool is turned and ground in the same clamping.

SUMMARY OF THE INVENTION

Proceeding from this prior art, it is the object of the invention to provide a grinding center for grinding crankshafts in which the design complexity and the space requirement are significantly reduced and with which simultaneous grinding of main bearings, pin bearings, and end-side surfaces is possible in a particularly rapid and efficient manner with high quality.

In the inventive grinding center, the space requirement and structural complexity are reduced simply in that two stations for simultaneously grinding at least two bearings (at the same time) are combined to create one grinding center. In the first station, center sections of the pin-side and flange-side crankshaft end can be ground together with the main bearings, specifically on the face and/or in the diameter, and specifically by means of a profiled grinding wheel, the rotational axis of which is inclined relative to the Z axis of the workpiece; this grinding wheel is preferably arranged in the first station. Because all of the main bearings can be ground simultaneously in the first station, in contrast to the second station there is a time reserve that can be exploited. End-side surfaces, in particular those of the crankshaft flange, are ground time parallel, at least in part, to the main bearings and/or pin bearings.

When both stations are arranged with an axis orientation that is the same as the crankshafts to be ground, moving the crankshafts from one station to the other is also very simple. Moreover, arranging two grinding spindles for machining pin bearings on a common compound slide rest results in a number of advantages. These additional advantages are in particular simplification of the control of the grinding process and reducing the number of components and the space required.

The control of the common grinding of two pin bearings occurs inventively in that the advance and monitoring/correction of the abrasion and concentricity of the ground bearing is initially accomplished only by controlling the movements of the common pin bearing compound slide rest. In this phase, the main grinding abrasion is for both pin bearings. It is only when the target dimensions have nearly been attained that the first grinding spindle and the second grinding spindle are controlled differently in terms of movement. The first pin bearing grinding spindle, which is rigidly connected to the pin bearing compound slide rest with regard to the adjusting direction (X direction) of the grinding wheels is further controlled by controlling the pin bearing compound slide rest according to measurement and roundness data obtained via a measuring device such that the required final target values are attained for the grinding process in question.

The end-side flange of the crankshaft is preferably ground, specifically preferably finish-ground, time-parallel to the main bearings. The grinding wheel provided for this is profiled and inclined to the Z direction with regard to the axis of rotation such that the planar end surfaces and the cylindrical surfaces of the flange or pin can preferably be ground in one work step.

The roundness values do not necessarily have to be measured at each pin bearing. These correction values can be determined according to a measurement in the control and can be stored for a certain number of crankshafts until another roundness measurement is performed.

Although the advance of the second pin bearing grinding spindle in this phase does also follow the movement of the pin bearing compound slide rest, another movement component in the X direction overlays this movement. This additional movement component is a differential correction of dimensional and/or roundness deviations that occur on the two pin bearings that are being machined simultaneously. Such deviations can be caused for instance by different abrasion on the two grinding wheels. Another essential reason for this deviation is that the shafts warp slightly during the grinding process since stresses in the material can be released. In accordance with the invention, they are detected using continuous measurement of the dimensions and roundness of the two pin bearings, to which end each pin bearing is provided with corresponding measuring devices.

The differences between the two pin bearings that are to be corrected are only minor in the final phase of grinding; experiments have shown that they are in the range of hundredths or thousandths of a millimeter. Therefore a very small adjustment range is adequate for the movement of the second pin bearing grinding spindle. This range advantageously should be about +/−0.2 mm.

There is mutual adjustability between the two pin bearing grinding spindles in the axial direction on the compound slide rest. This makes it possible to adapt to different axial distances between the pairs of pin bearings that are to be ground, and also to adjust for different types of crankshafts. Axial adjustability is usefully included and automatically triggered in the machine control. In general the second pin bearing grinding spindle, which is already arranged to be adjustable in the radial direction, is also embodied to be axially adjustable, but the reverse design is also possible, wherein the second pin bearing grinding spindle is axially fixed on the pin bearing compound slide rest while the first pin bearing grinding spindle is used for axial displacement on the pin bearing compound slide rest.

Preferably in embodying the invention one design of the drive is for moving the one (second) grinding spindle in the dimensional and roundness correction axis as an NC axis, since in this simple manner it is possible to integrate the CNC machine control.

There is also an advantage in designing the grinding cell so that the planar sides of the cheeks of the crankshaft, which normally form the transition from the bearing to the actual cheek, are also ground in the first station during machining. The time T1 can be used and adapted such that two pairs of pin bearings are machined in the corresponding time T2.

The planar sides of the cheeks can be ground at the bearing points on the crankshafts either by displacing the main bearing compound slide rest in the Z direction or in that the main bearing grinding wheels are displaced axially on the main bearing grinding spindle. However, it is also possible to displace the crankshaft in the axial direction relative to the main bearing grinding wheels.

Particularly efficient operation of the grinding center results when the machining times T1 and T2 for the main bearings or pin bearings are coordinated with one another because then the two stations can be loaded and unloaded simultaneously and thus waiting times are eliminated.

The pin chasing method is preferably used for grinding the pin bearing, this simplifying the bearing and drive of the crankshaft for machining the pin bearings. The main bearings ground in the first station can be used with nothing further for bearing the crankshaft in the second station, so that it is possible to attain a high level of precision when machining the pin bearings. Moreover, the inventive arrangement and control of the two pin bearing grinding spindles on only one compound slide rest means that there is only a single feed slide. Thus, a single feed slide causes the main movement of the two grinding wheels, specifically the pin chasing movement and the advance. This leads to significant simplification in the control compared to the prior art, since only one feed slide must be monitored and controlled during most of the machining. The control of the movement of the two grinding spindles, which is different in the final phase of the grinding, ensures that any deviations between the two pin bearings are detected and compensated so that ultimately both pin bearings are ground to the target dimensions.

The clamping and rotational drive of the crankshafts via specially embodied main bearing headstocks and pin bearing headstocks or corresponding tailstocks permits the grinding center to be employed in a particularly flexible manner. Clamping the crankshaft with the option of rotation about the main bearing longitudinal axis or about the pin bearing longitudinal axis permits selection between normal grinding or pin chasing grinding for the pin bearing grinding.

Continuous measurement of the dimensions and roundness of the bearing being machined permits real-time detection of and extremely precise correction to the grinding.

The grinding wheel for grinding the flange is preferably arranged opposite the side of the crankshaft on which the grinding wheels for the pin bearings and main bearings are arranged. However, in accordance with another preferred embodiment, it is also possible for all of the grinding wheels to be arranged on one side of the crankshaft. The grinding wheel for grinding the flange and/or the pin is either provided in the first station for grinding the main bearings or in the second station for grinding the pin bearings or in each of the two stations.

Naturally, in addition to four-cylinder crankshafts other crankshafts can also be ground using an inventive grinding center if they have two pin bearings attached to the crankshaft in the same angular position. Likewise, it is possible to machine camshafts if they have at least two main bearings and two cams arranged in the same angular position.

The invention also relates to a method for grinding the main bearings and pin bearings and/or center sections of crankshafts.

In the inventive method, the end-side surfaces of the flange or pin of the crankshaft are ground, at least in part, at the same time as their main bearings and/or pin bearings.

The grinding center and the method in accordance with the invention are explained in greater detail in the following using the exemplary embodiments depicted in the drawings.

DETAILED DESCRIPTION OF THE INVENTION

Figure 1:
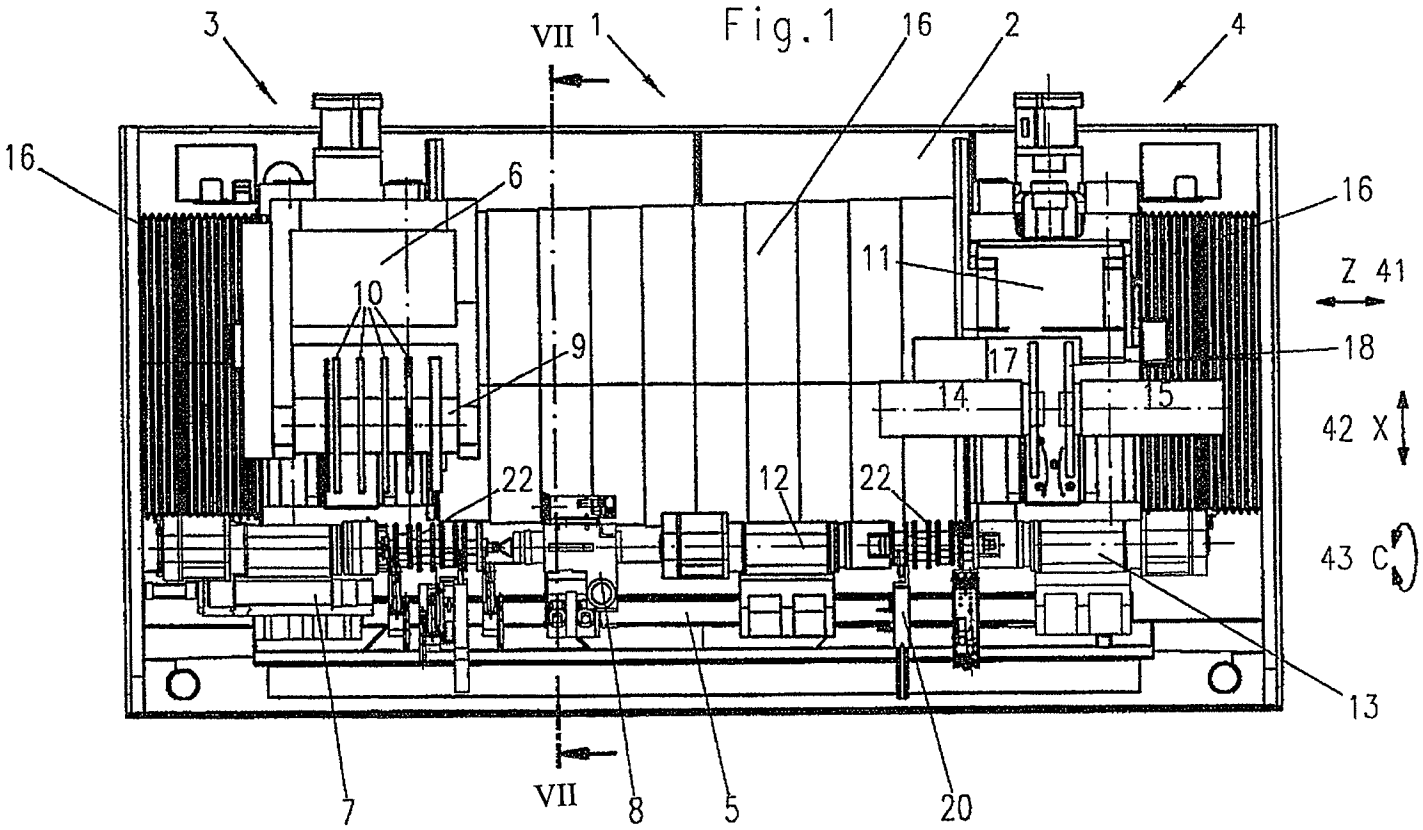
FIG. 1 is a schematic top view of a grinding center according to the invention that is embodied as a grinding cell.

FIG. 1 is a top view of a grinding center embodied as a grinding cell 1. This grinding cell has a common machine bed 2 on which are arranged two stations 3, 4 for machining crankshafts 22 by grinding. The stations 3, 4 have a common grinding table 5 on which holding apparatus and drives for each of the crankshafts 22 are present. The grinding cell also normally has a machine cover and loading and unloading apparatus for feeding in and removing the crankshafts 22 and for transporting them from the first station 3 to the second station 4. These are not shown in FIG. 1, however, nor is the CNC control device with input keyboard or hydraulic and/or pneumatic supply devices shown.

Figure 2:
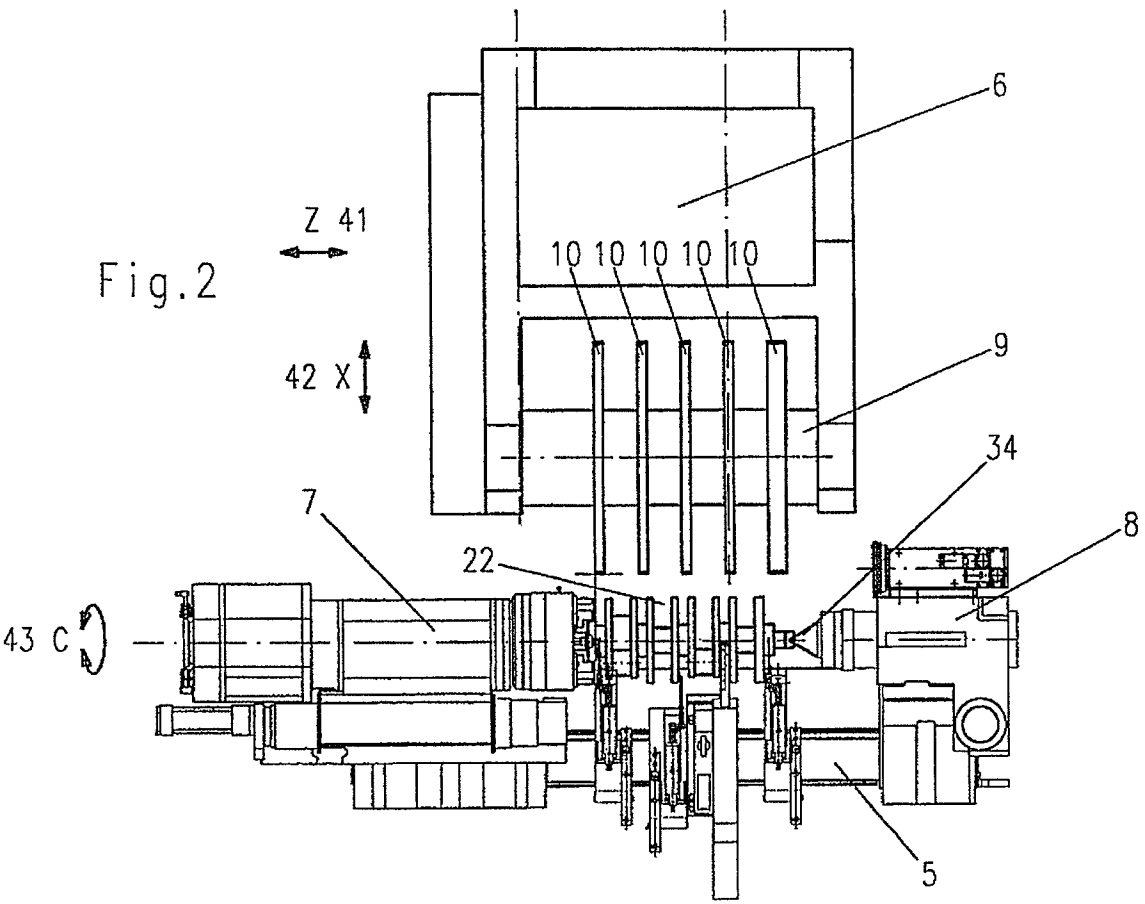
FIG. 2 is a schematic top view of the first station of the grinding cell, which is used for machining the main bearings of a crankshaft.
Figure 4:
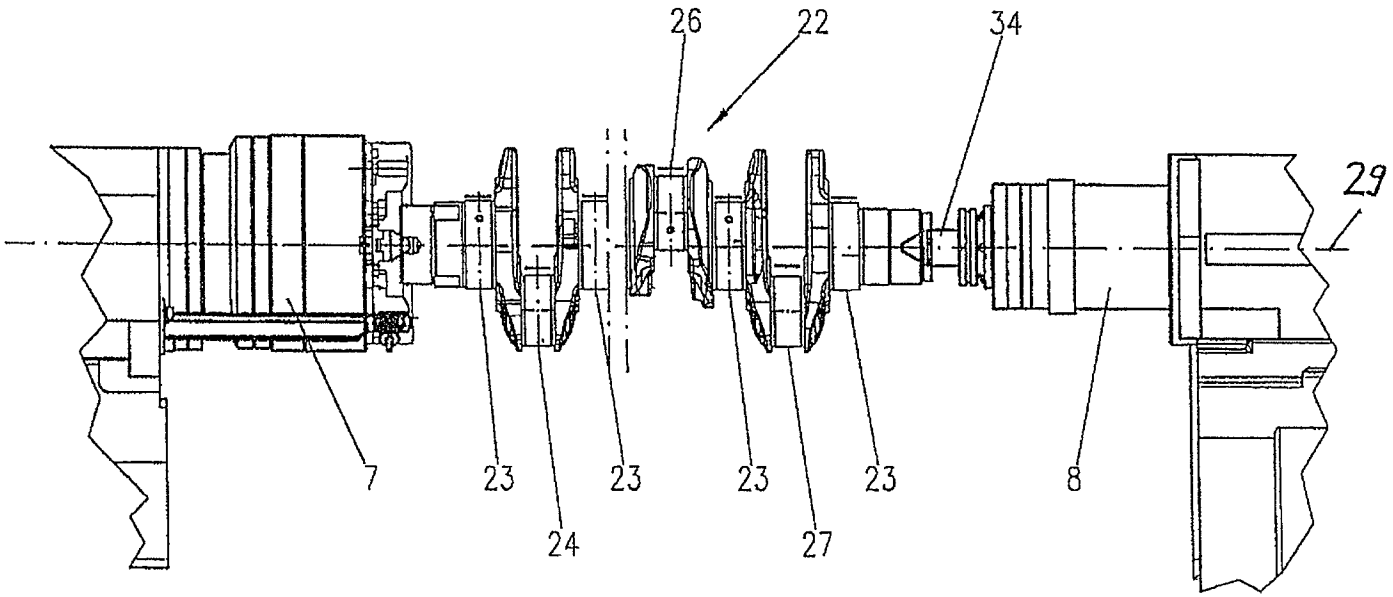
FIG. 4 depicts the clamping of the crankshaft in the first station of the grinding cell.

The first station 3 for the grinding cell 1, which is depicted individually in FIG. 2, is for grinding the main bearings 23 of the crankshafts 22. To promote understanding, the most important functional parts in the first station 3 therefore have "main bearing" added to their identifiers. The main bearings 23 (FIG. 4) are ground by means of a plurality of main bearing grinding wheels 10 that are arranged on a main bearing grinding spindle 9. The main bearing grinding spindle 9 itself is attached to a main bearing compound slide rest 6 that can be moved, CNC controlled, in the Z direction, which corresponds to the crankshaft longitudinal axis 29, and in the X direction, which permits an adjustment perpendicular to the crankshaft longitudinal axis 29. Guide or slide tracks on which the main bearing compound slide rest 6 is moved in the Z direction are not shown because they are covered by covers 16. The crankshaft 22 to be machined is clamped between a main bearing workpiece headstock 7 and a main bearing tailstock 8, as is shown in greater detail in FIG. 4, and in accordance with the depiction in FIG. 2 is caused to rotate by the main bearing headstock 7. At least two main bearings 23 on the crankshaft 22 are rough-ground or finish-ground simultaneously in the first station 3, a time T1 being required for this.

Figure 3:
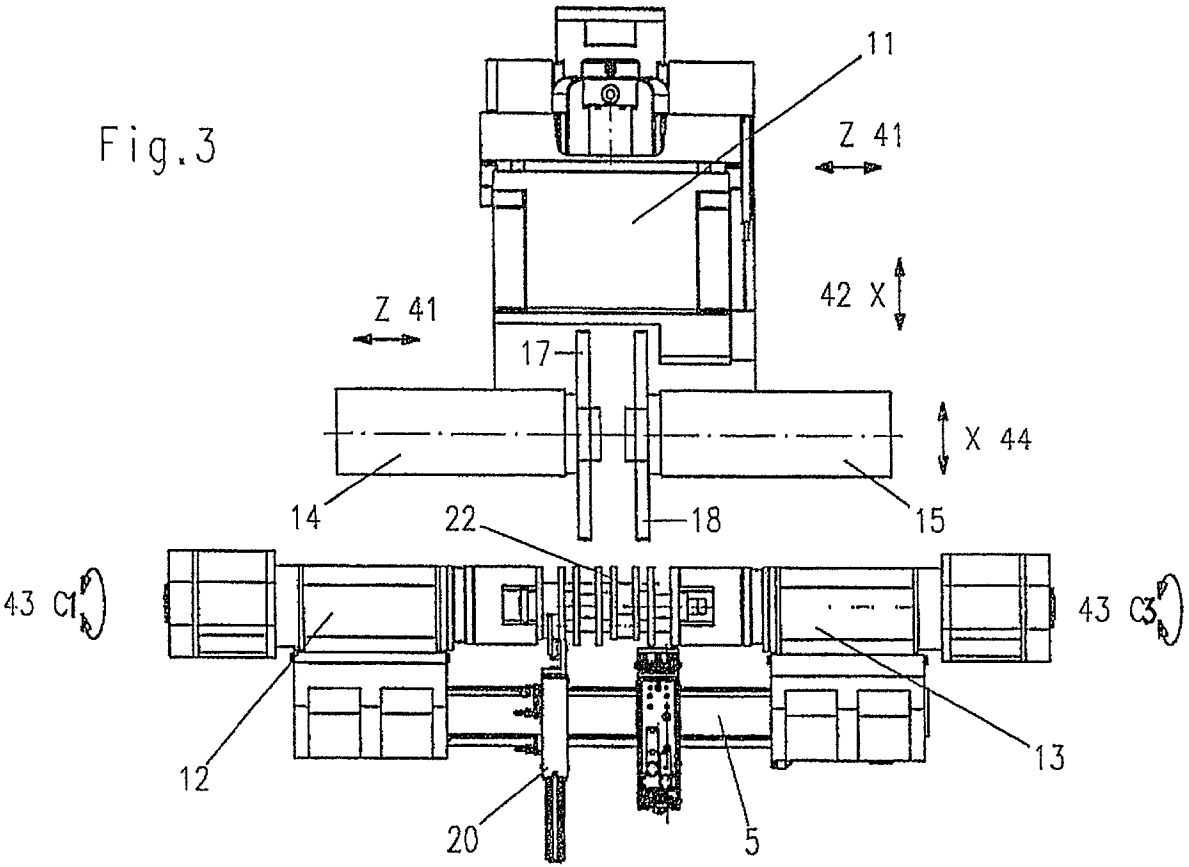
FIG. 3 is a schematic top view of the second station of the grinding cell, which is employed for machining the pin bearings.

The second station 4 in the grinding cell 1, which is depicted individually in FIG. 3, is employed for machining the pin bearings 24 through 27 on the crankshaft 22, two pin bearings 24 through 27 that are disposed in the same angular position with respect to the crankshaft longitudinal axis 29 being ground simultaneously. The time required for grinding all four pin bearings 24 through 27 is T2. To promote understanding, the most important functional parts of the second station 4 therefore have "pin bearing" added to their identifiers.

The crankshaft 22 to be ground is also clamped centrally in the second station 4, i.e. the common longitudinal axis of the clamping devices on both sides is the same as the longitudinal axis 29 of the crankshaft 22, which is defined by its main bearings 23. As can be seen from FIGS. 3 and 5, in the second station 4 the crankshaft 22 is clamped at its exteriorly disposed main bearings 23, which have been ground in the first station 3. This produces a precise reference for the pin bearings 24 through 27 to the main bearings 23 of the crankshaft.

In accordance with FIG. 3, pin bearing workpiece headstocks 12, 13 are provided on both sides of the crankshaft 22 for clamping. The chucks 31 for these pin bearing workpiece headstocks 12, 13 are provided with supports and each is driven by the C1 or C2 axis, which rotate absolutely synchronously. However, in the second station 4 the crankshaft 22 can also be received between tips and is then driven by a pin bearing workpiece headstock 12, at least only on one side, the chuck of which is provided with floating clamping jaws 33 and effects an equalizing, radially no-clearance rotary drive. The crankshaft 22 is then aligned by centering it on the centering tips.

The manner in which the crankshaft 22 is received in the second station can be varied and optimized according to the individual circumstances. In both stations 3 and 4, the crankshaft 22 can be supported by one or a plurality of self-centering steadies.

Provided in the second station is a pin bearing compound slide 11 that can be moved in the direction of the axes Z2 and X2, which are perpendicular to one another, and thus can be moved parallel to the crankshaft longitudinal axis 29 and perpendicular thereto. The pin bearing compound slide 11 supports a first pin bearing grinding spindle 14 and a second pin bearing grinding spindle 15. The first pin bearing grinding spindle 14 is securely connected hereby to the pin bearing compound slide 11 in the direction perpendicular to the crankshaft longitudinal axis 29. In contrast, the second pin bearing grinding spindle 15 is arranged movable in the direction perpendicular to the crankshaft longitudinal axis 29 on the pin bearing compound slide 11. Its movement is controlled based on a dimensional or roundness error that is obtained from an in-process measurement during grinding. To this end, in-process measuring heads 19 for a measuring device 20 (FIG. 6) continuously measure the diameter of the pin bearings 24, 27 or 25, 26, which are ground in pairs, during the grinding.

Each of the two pin bearing grinding spindles 14, 15 supports a pin bearing grinding wheel 17, 18 whose axial distance from one another must be equal to the distance between the pin bearings 14 through 17 that are to be ground in pairs. To this end, the two pin bearing grinding spindles 14, 15 must be movable relative to one another axially on the pin bearing compound slide rest 11, that is, in the direction of the rotational axis of their pin bearing grinding wheels 17, 18. The axial distance between the pin bearing grinding spindles and pin bearing grinding wheels must be adjusted every time a different type of crankshaft is to be ground or when a specific crankshaft that has a pair of pin bearings with a different distance between them is to be ground next. To this extent the change in the distance must be included in the entire control of the grinding process. The first pin bearing grinding spindle 14 or the second pin bearing grinding spindle 15 can be arranged displaceable in the direction of its longitudinal axis on the pin bearing compound slide rest 11.

Figure 5:
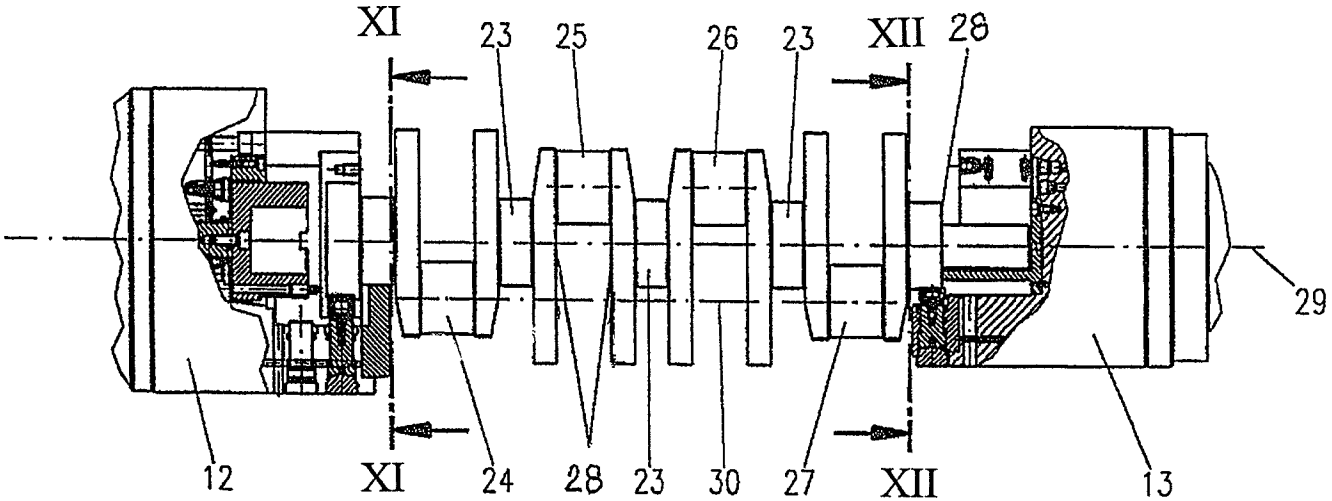
FIG. 5 depicts details of the clamping of the crankshaft in the second station of the grinding cell.
Figure 12:
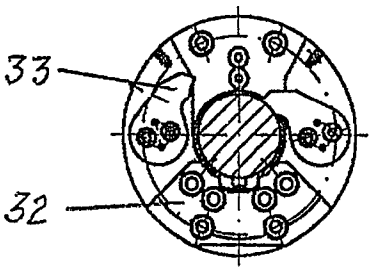
FIG. 12 is a partial section along the section line XII-XII in FIG. 5.
Figure 11:
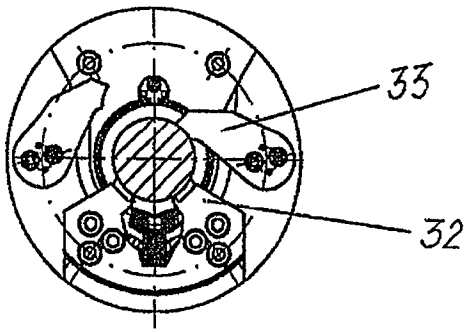
FIG. 11 is a partial section along the section line XI-XI in FIG. 5.

FIGS. 5, 11 and 12 provide a particularly clear depiction of the particularity of crankshafts 22 for four cylinder in-line engines: the two outer pin bearings 24 and 27 have the same angular position with respect to the rotational and longitudinal axis 29 of the crankshaft 22, as do the two interior pin bearings 25 and 26, the angular position of the two pairs of pin bearings 24, 27 and 25, 26 differing from one another.

This attribute is used for operating the inventive grinding center in an economic manner. Specifically, the two pin bearings 24, 27 and 25, 26 are each ground simultaneously using the two pin bearing grinding wheels 17 and 18, the term "simultaneously" also having the same meaning as the grinding terms "time-parallel" or "at the same time". In any case, what is meant is that the grinding process unfolds in approximately the same time, but not that it must be ended at exactly the same point in time. The second pin bearing is frequently not finish-ground until after the first pin bearing, in that e.g. a dressing amount of 0.02 mm is to be removed.

Figure 6:
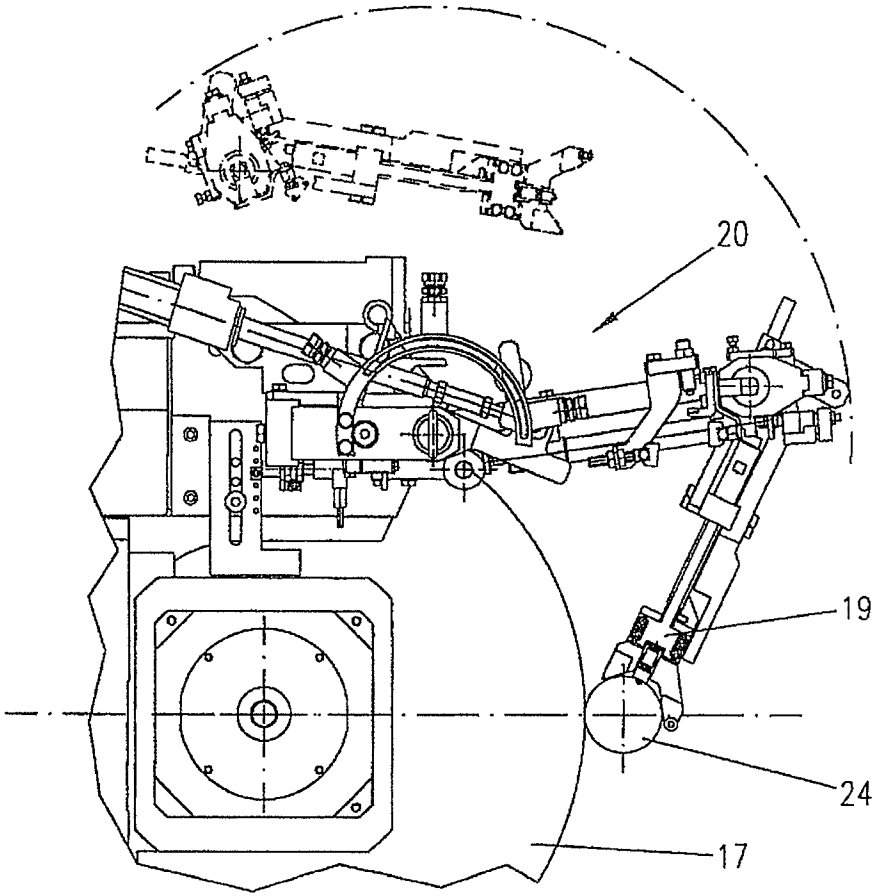
FIG. 6 depicts the arrangement of a device for measuring the dimensions and roundness of a bearing to be machined in the second station.

FIG. 6 depicts the arrangement of a measuring device 20 for continuously measuring the roundness and dimensions of a pin bearing in the second station 4 by means of a measuring head 19. During grinding, the measuring head 19 is positioned against pin bearing 24-27 that is to be monitored and continuously generates signals regarding the dimensions and/or roundness of the pin bearing 24-27, which signals are evaluated by the CNC control and used to generate control commands for the drives for the pin bearing compound slide 11 and/or the dimensions and roundness correction axis 44. The position of the measuring device 20 indicated by the broken lines is a retracted position that the measuring device 20 assumes for instance during a dressing process and/or when the parts of the pin bearing grinding wheels 17, 18 are being handled.

Figure 7:
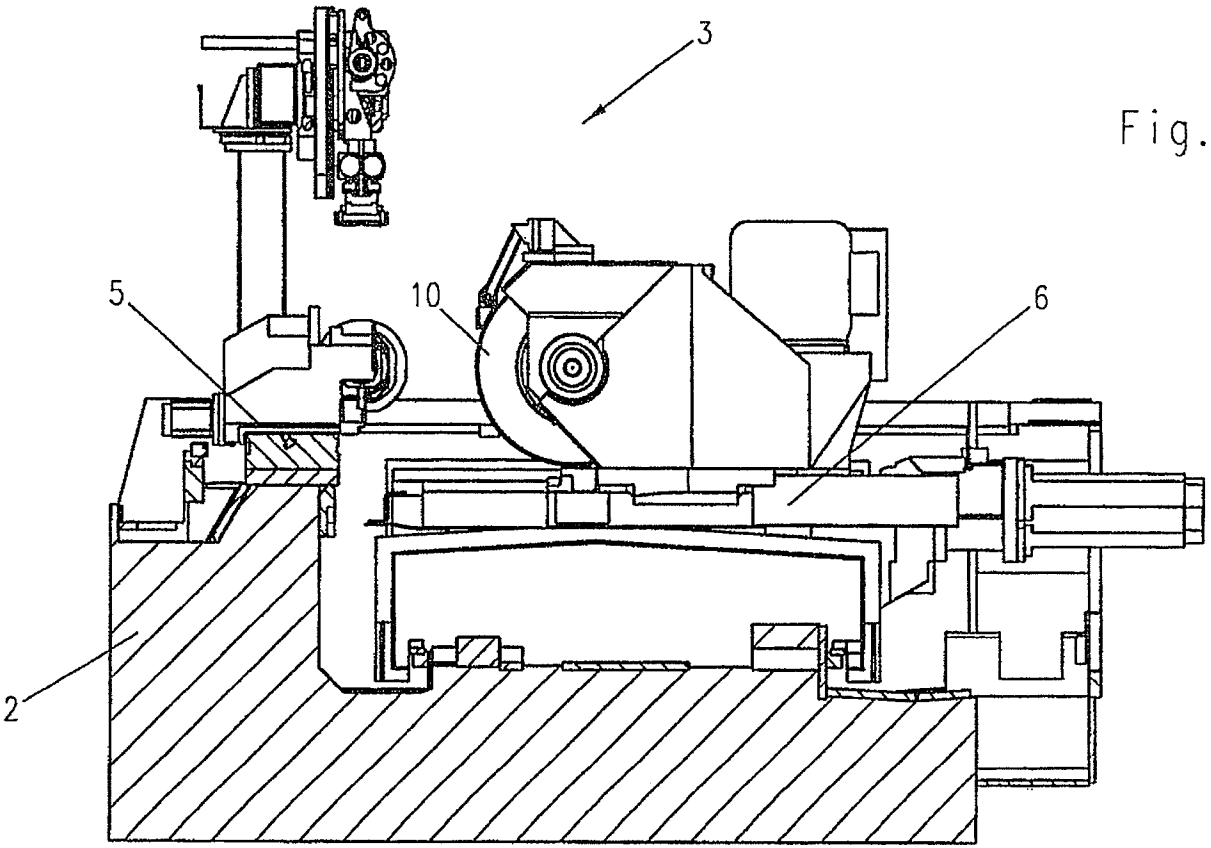
FIG. 7 is a section through a grinding cell according to the invention along the section VII-VII in FIG. 1.

FIG. 7 depicts a schematic side elevation of the first station 3 in the grinding cell 1 in accordance with the section VII-VII in FIG. 1.

At the beginning of the pin bearing grinding in the second station 4, the mutual axial distance between the two pin bearing grinding wheels 17, 18 is adjusted, for instance, to the distance between the pin bearings 24 and 27. Then grinding of these pin bearings 24, 27 begins with the pin chasing method that is CNC controlled. For this, first the two pin bearing grinding spindles 14, 15 are moved together perpendicular to the crankshaft longitudinal axis 29. The second pin bearing grinding spindle 15 remains stationary relative to the pin bearing compound slide rest 11. This applies both to the rough-grinding phase and the finish-grinding phase. However, the diameter just attained for each of the pin bearings 24, 27 is measured during grinding and its roundness is determined. As the finished dimensions are neared in the finish-grinding phase, the movement by the second grinding spindle 15 is decoupled from that of the pin bearing compound slide rest 11. The pin bearing compound slide rest 11 is moved according to the measurement on the pin bearing 24 in the sense of a dimension or roundness correction axis 44, the final dimensions and the required roundness of the pin bearing 24 finally being attained by means of the first pin bearing grinding spindle 14. The second pin bearing grinding spindle 27 simultaneously performs correction movements with respect to the pin bearing compound slide 11 according to the separate measurement on the pin bearing 27 if the measurements for the pin bearing 27 differ from those for the pin bearing 24. These differences result from the continuous measurement for both pin bearings 24 and 27. The computer for the machine control analyzes the measurement results and provides corresponding correction and control signals for the drive for the second pin bearing grinding spindle 15.

Naturally, the second pin bearing grinding spindle 15 only needs to be slightly movable in the direction of the X axis with respect to the pin bearing compound slide rest 11. An advantageous displacement path, in practice, can be, for instance, in the range of +/−0.2 mm. The grinding center can be adjusted such that the grinding time T1 is equal to the grinding time T2. Two of the main bearings 23 are then ground in approximately the same time as a pair 24, 27 or 25, 26 of the pin bearings.

Then the pin bearing compound slide rest 11 is withdrawn, the distance between the two pin bearing grinding spindles 14, 15 is adjusted to the distance between the center pin bearings 25, 26, and the grinding cycle starts over.

Figure 8:
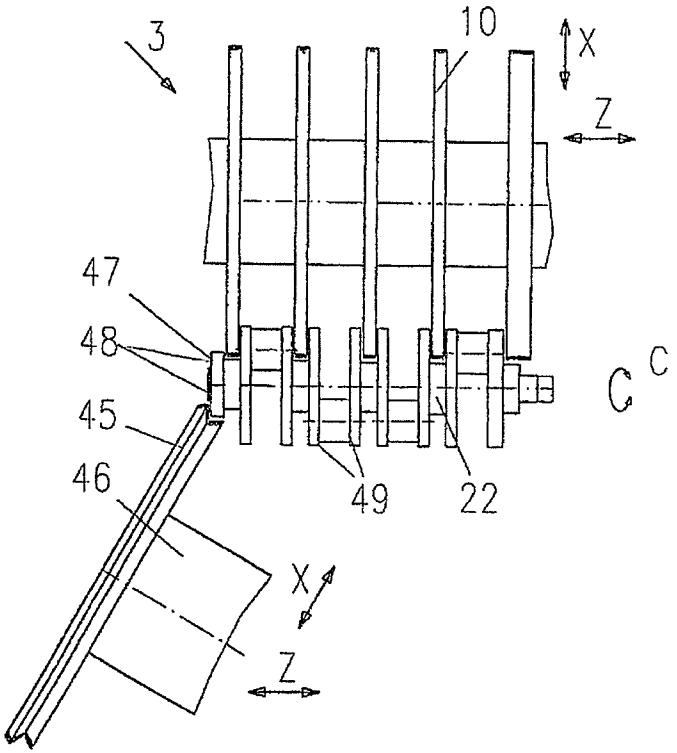
FIG. 8 is a schematic elevation of the first station of the grinding cell having a profiled grinding wheel, for the flange, arranged opposite the main bearing grinding wheels.

FIG. 8 provides a simplified schematic drawing of the first station in the grinding cell, in which drawing the main bearings 23 on the crankshaft 22 are undergoing multilayer grinding by means of main bearing grinding wheels 10. In the first station 3 the main bearing grinding wheels 10 grind the main bearings 23. If the planar surfaces of the cheeks of the crankshaft 22 that have the main bearing pins are to be ground, the spindle with the main bearing grinding wheels is moved axially relative to the crankshaft 22. However, it is also possible for the crankshaft 22 to be moved along its rotational axis relative to the main grinding wheels 10. A profiled grinding wheel 45 is arranged opposite the main bearing grinding wheels 10 on a spindle 46 that is inclined relative to the Z axis, i.e. to the spindle axis of the main bearing grinding wheels 10. The grinding wheel 45 is profiled such that and its angle to the Z axis is arranged such that the flat end faces and also the cylindrical surfaces of the flange 47 on the crankshaft 22 can be ground simultaneously. The grinding wheel 45 can be adjusted along the adjusting axis X.

Figure 9:
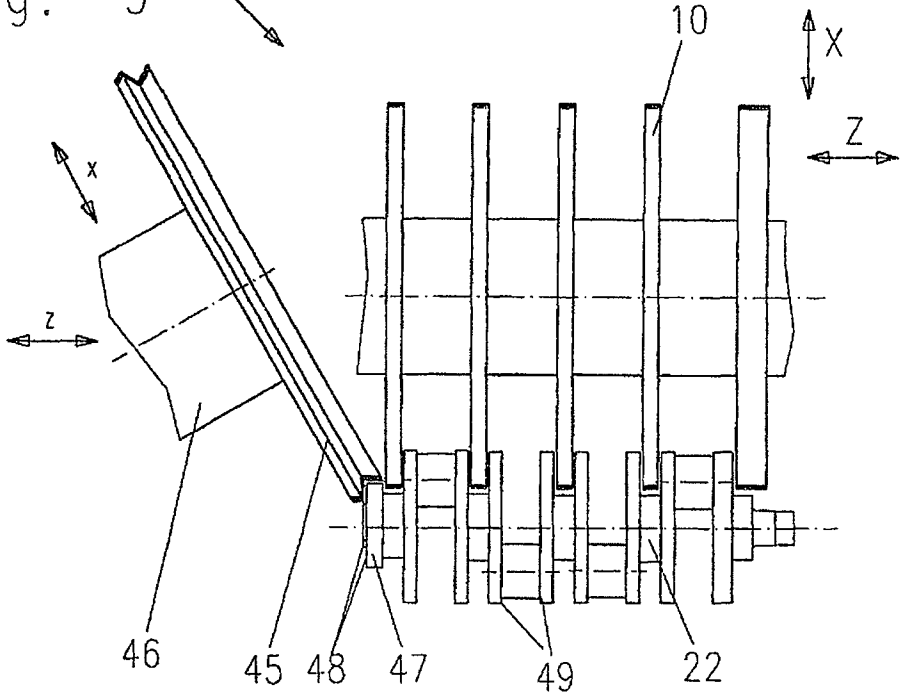
FIG. 9 is an elevation in accordance with FIG. 8, but with the profiled grinding wheel arranged on the side of the main bearing grinding wheels.

FIG. 9 is an elevation in accordance with FIG. 8 in which, in contrast to the arrangement in accordance with FIG. 8, the profiled grinding wheel 45 with its spindle 46 is arranged on the same side of the crankshaft 22 as the main bearing grinding wheels 10. The end-side surfaces 48, specifically the flat end faces and the cylindrical surfaces of the flange, are ground in one work step using the profiled grinding wheel 45, it being possible to adjust the profiled grinding wheel 45 along its adjusting axis X.

In accordance with this embodiment, the main bearing grinding wheels 10 are arranged on a common spindle and grind the main bearings between the cheeks 49 of the crankshaft 22.

Figure 10:
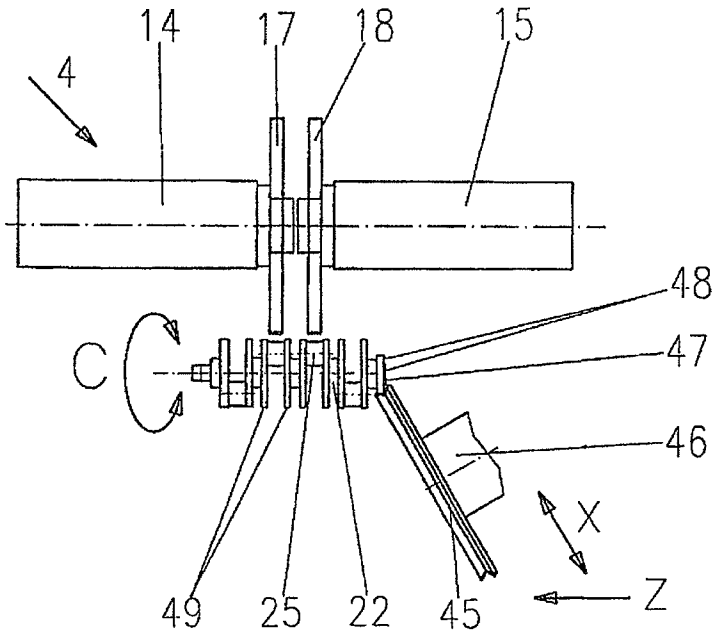
FIG. 10 is a schematic elevation of the second station of the grinding cell having a profiled grinding wheel, for the flange, arranged opposite the pin bearing grinding wheels.

FIG. 10 is a schematic elevation of the second station 4 of the grinding cell having a profiled grinding wheel 45 arranged opposite the pin bearing grinding wheels 17, 18 for grinding the cylindrical and flat surfaces 48 of the flange 47 on the crankshaft 22. The profiled grinding wheel 45 with its spindle 46 can be adjusted along its adjusting axis X and grinds the flange 47 in one work step. The profiled grinding wheel 45 is arranged opposite the pin bearing grinding wheels 17,18 in order to avoid any collision of the grinding wheels and in order to obtain simultaneous machining of the surfaces to be machined. The pin bearing grinding wheels 17, 18 with their spindles 14, 15 grind each pin bearing between the cheeks 49 using the pin chasing grinding method.

The invention claimed is:

1. A grinding center for grinding crankshafts which include main bearings, pin bearings and end-side surfaces, comprising:

a first station for grinding the main bearings, comprising:

a group of main bearing grinding wheels being arranged on a main bearing grinding spindle, said main bearing grinding spindle being arranged on a main bearing compound slide rest such that a number of main bearings that equals a corresponding number of the main bearing grinding wheels are ground time-parallel in a time T1;

a profiled grinding wheel that is drivable by a grinding spindle arranged at an angle to the main bearing grinding spindle and the pin bearings, said profiled grinding wheel being operable to grind the end-side surfaces of the crankshaft; and and a second station for grinding the pin bearings, comprising:

two pin bearing grinding wheels operable to grind two said pin bearings on the crankshaft by pairs in a time T2, said two pin bearing grinding wheels with respective pin bearing grinding spindles thereof being borne on a pin bearing compound slide rest such that a first one of said pin bearing grinding spindles is arranged location-fast on the pin bearing compound slide in an adjusting direction along an x-axis and a second one of said pin bearing grinding spindles can be slightly displaced in the adjusting direction relative to the first pin bearing grinding spindle only in a sense of a dimension or roundness correction axis.

2. A grinding center according to claim 1, wherein the first and second pin bearing grinding spindles disposed on the pin bearing compound slide rest are displaceable in an axial direction along a z-axis relative to one another.

3. A grinding center according to claim 1, wherein the second one of the pin bearing grinding spindles in the second station is adjustable by operation of an NC axis that is effective in narrow limits for dimension and/or roundness correction, irrespective of the movement of the pin bearing compound slide towards the crankshaft.

4. A grinding center according to claim 1, wherein the main bearing grindings wheels of the main bearing grinding spindle in the first station is adjustable radially for grinding the main bearings, and is adjustable axially for grinding planar sides of cheeks on the crankshaft.

5. A grinding center according to claim 4, wherein an axial offset of the main bearing grinding wheels occurs using the main bearing compound slide rest.

6. A grinding center according to claim 4, wherein an axial offset of the main bearing grinding wheels occurs in that the main bearing grinding wheels are arranged axially displaceable on the main bearing grinding spindle.

7. A grinding center according to claim 1, wherein the crankshaft is axially displaceable in a crankshaft longitudinal direction for grinding planar sides of cheeks by operation of the main bearing grinding wheels.

8. A grinding center according to claim 1, wherein T1 is approximately equal to T2.

9. A grinding center according to claim 1, wherein the pin bearing compound slide rest is operable to impart a pin chasing movement to the pin bearing grinding wheels.

10. A grinding center according to claim 1, wherein the first station and the second station each includes a workpiece headstock and a workpiece tailstock, and each said workpiece headstock and said workpiece tailstocks for the first and second station are configured such that the crankshaft that has a main bearing longitudinal axis and at least one pin bearing longitudinal axis can be rotated about the main bearing longitudinal axis.

11. A grinding center according to claim 1, further comprising a measuring device for continuously measuring dimensions and roundness, said measuring device supplying a signal for controlling movement of the pin bearing grinding spindle in the adjusting direction or in the dimension or roundness correction axis.

12. A grinding center according to claim 1, wherein:

the grinding wheel for grinding the end-side surfaces has profiling such that an end-side flange and/or pin on the crankshaft can be ground with axial and radial surfaces thereof, and the grinding wheel is arranged on a side of the crankshaft that is opposite a corresponding side of the main bearing grinding wheels or pin bearing grinding wheels.

13. A grinding center according to claim 1, wherein the grinding wheel for grinding an end-side flange and/or pin on the crankshaft with axial and radial surfaces thereof by virtue of the profiling is arranged on a side of the main bearing grinding wheels or pin bearing grinding wheels.

14. A method for grinding main bearings, center sections, pin bearings and end-side surfaces of crankshafts in a grinding center that includes two stations in accordance with claim 1, the method comprising:

a) grinding the main bearings on the crankshaft and/or center sections with a set of main bearing grinding wheels that are disposed on a common shaft of a main bearing grinding spindle in the first station;

b) moving the crankshaft to the second station;

c) grinding first and second pin bearings that have a same angular position relative to the rotational axis of the crankshaft at a same time with first and second pin bearing grinding wheels in the second station;

d) individually computer-controlling adjusting movement for each of the two pin bearing grinding wheels, the adjusting movement for the second pin bearing grinding wheel being made only according to a deviation from the adjusting movement of the first pin bearing grinding wheel; and e) simultaneously machining two crankshafts in the grinding cell, a grinding time T1 in the first station being approximately the same as a corresponding grinding time T2 in the second station, and at least one of end-side surfaces is ground time-parallel, at least in part, to the main bearings and/or pin bearings.

15. A method according to claim 14, wherein the two pin bearing grinding wheels are disposed on pin bearing grinding spindles that are arranged on a pin bearing compound slide rest, the first pin bearing grinding spindle being arranged location-fast in an adjusting direction along an x-axis with the first pin bearing grinding wheel on the pin bearing compound slide rest and being adjusted thereby, while the second pin bearing grinding spindle with the second pin bearing grinding wheel is adjustable by operation of an NC axis that is effective in narrow limits for dimension and/or roundness correction, irrespective of the movement of the pin bearing compound slide towards the crankshaft.

16. A method according to claim 14, wherein the main bearing grinding wheels of the main bearing grinding spindle are adjusted radially for grinding the main bearings and are displaced axially for grinding planar sides of cheeks on the crankshaft.

17. A method according to claim 16, wherein the main bearing grinding wheels are axially displaced by axial displacement of a main bearing compound slide.

18. A method according to claim 16, wherein the main bearing grinding wheels are axially displaced by axial displacement on a main bearing grinding spindle.

19. A method according to claim 14, further comprising grinding planar sides of cheeks on the crankshaft by operation of the main bearing grinding wheels while the crankshaft is axially displaced.

* * * * *